219-121 SR

2/15/83 OR 4,374,315

United States Patent [19]

Timbrook

[11] 4,374,315

[45] Feb. 15, 1983

[54] GOLF CLUB SHAFT AND METHOD OF MAKING THE SAME

[76] Inventor: Robert L. Timbrook, 883 Linda Flora Dr., Los Angeles, Calif. 90049

[21] Appl. No.: 297,029

[22] Filed: Aug. 27, 1981

Related U.S. Application Data

[62] Division of Ser. No. 117,964, Feb. 4, 1980, abandoned.

[51] Int. Cl.[3] ..... B23K 27/00

[52] U.S. Cl. ..... 219/121 LD; 219/121 LC; 228/173 C

[58] Field of Search ..... 219/121 LC, 121 LD, 219/121 LH, 121 LJ, 121 EC, 121 ED, 101, 102, 105; 273/80 B, 72 A, 80.9; 228/173 C, 182

[56] References Cited

U.S. PATENT DOCUMENTS

| | | | |
|---|---|---|---|
| 1,499,128 | 6/1924 | Shroyer, Jr. | 273/72 A |
| 1,936,158 | 11/1933 | Dyer | 219/105 X |
| 2,033,722 | 3/1936 | MacFarland | 273/80.9 |
| 2,992,828 | 7/1961 | Stewart | 273/80 B |
| 3,461,593 | 8/1969 | Murtuch et al. | 273/80 B X |
| 3,472,998 | 10/1969 | Popick et al. | 219/121 LH |
| 3,648,007 | 3/1972 | Oppermann et al. | 219/121 EC X |
| 3,755,646 | 8/1973 | Muller | 219/121 LH |
| 3,833,223 | 9/1974 | Shulkin | 273/80 B X |
| 3,941,973 | 3/1976 | Luck, Jr. et al. | 219/121 LH |
| 4,105,205 | 8/1978 | Theodores et al. | 273/73 J |
| 4,152,573 | 5/1979 | Savrin et al. | 215/121 LD X |

FOREIGN PATENT DOCUMENTS

| | | | |
|---|---|---|---|
| 1313751 | 4/1973 | United Kingdom | 273/80 B |

*Primary Examiner*—C. L. Albritton

*Attorney, Agent, or Firm*—William C. Babcock

[57] ABSTRACT

A golf club shaft of such structure that the stiffness thereof is controlled by rotatably adjusting the shaft relative to the striking surface of the club head associated with the shaft. The shaft is also of such structure that the torque developed on the club head upon impact with a golf ball is distributed over the entire length of the shaft, and the club head as a result thereof having a minimum tendency to rotate relative to the arcuate path through which it travels. Due to the two above-mentioned operational advantages a club embodying the shaft permits the user to impart maximum kinetic energy to the ball impacted thereby and the ball having a minimum tendency to deviate laterally in flight from an extension of the arcuate path through which the golf club head moves. The invention also includes a method of making the shaft.

2 Claims, 11 Drawing Figures

FIG. 1
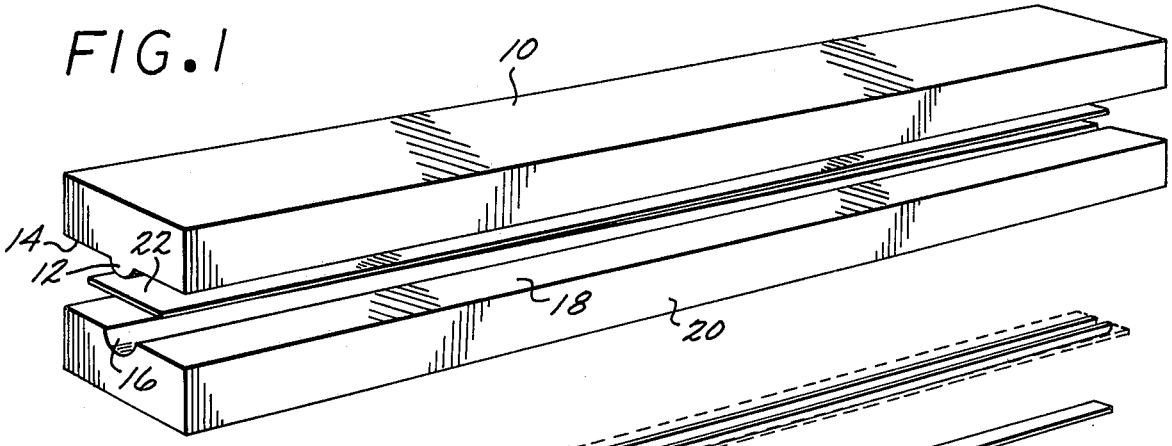
FIG. 2
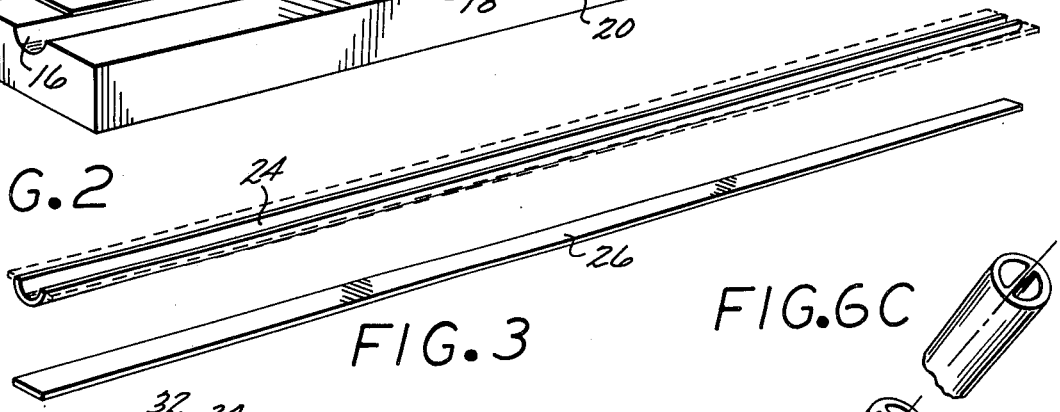
FIG. 3
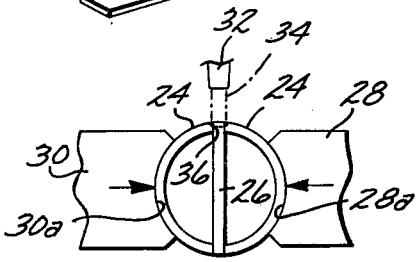
FIG. 4
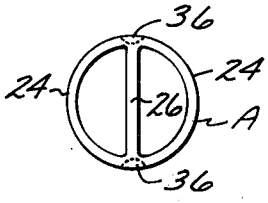
FIG. 5
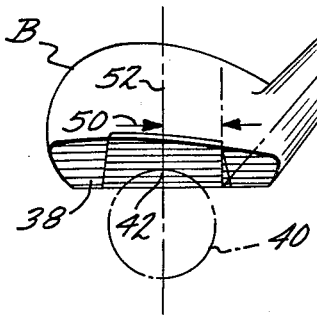
FIG. 6
FIG. 6C
FIG. 6B
FIG. 6A
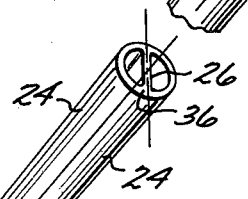
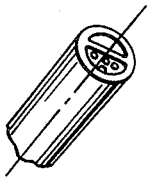
FIG. 7
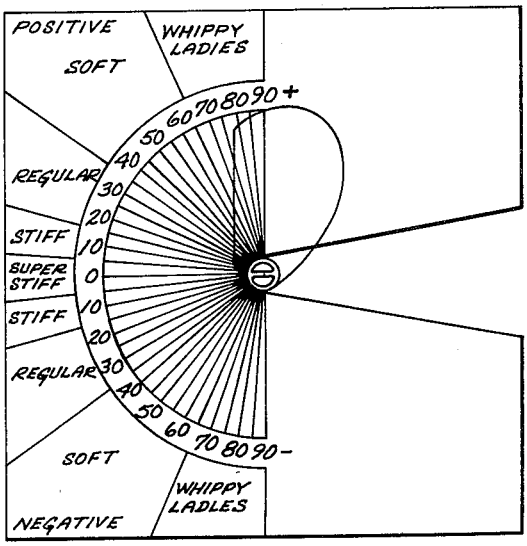
FIG. 8

GOLF CLUB SHAFT AND METHOD OF MAKING THE SAME

REFERENCE TO RELATIVE APPLICATION

This application is a division of application Ser. No. 117,964 filed Feb. 4, 1980, abandoned, by applicant entitled "GOLF CLUB SHAFT AND METHOD OF MAKING THE SAME".

BACKGROUND OF THE INVENTION

1. Field of the Invention

Golf Club Shaft and Method of Making the Same.

2. Description of the Prior Art

Since approximately 1930 tapered hollow tubular golf shafts have been approved for all competition. However, from time-to-time golf shafts made from different materials have appeared, but in the main these shafts have offered no overall advantage over steel shafts. The steel golf shaft is the most common shaft now in use.

In golf it is distinct advantage to be able to hit the longest ball accurately within a given set of conditions. The distance the ball will travel is dependent on a number of variables, but primarily the mass of the golf club head impacting the ball times the acceleration of the head. The force exerted upon the impacted golf ball is thus dependent on both the mass of the golf club head and the rate of acceleration, and by increasing either of these the force could theoretically be increased. However, in actual practice if the mass of the golf club head is increased the acceleration decreases and likewise the rate of acceleration can only be increased by a decrease in the mass of the golf club head. Thus, varying these two factors does not in the overall provide an increase in the force exerted on the impacted golf ball.

The optimum configuration of a golf club is described as a "swing weight" which is measured on a special scale, and every golfer has an optimum swing weight to fit his particular physical capabilities. If the mass of a golf club head can be increased without increasing the total weight of the club head itself, then more energy can be imparted to the ball. This can only be accomplished by removing weight from the golf club shaft and/or grip, and adding this mass to the golf club head. This will increase the swing weight of a given club without increasing the total weight of the club, and will enable a golfer to impart more momentum to a ball and achieve the much desired longer ball. A second possibility is to design a shaft and head that will have a greater capability to transfer the kinetic energy of the golf club to the golf ball. If this is achieved, the ball will again fly farther under a given set of conditions. High speed photographs of a golf club swing show the effect of the ball inertia and recovery ability upon the club face itself. Kinetic energy can only be imparted to the golf ball while the club head is in contact with the ball. Several factors effect this contact.

One of these factors is the mass of the club head and the acceleration at which it is traveling upon contact with the ball. Another factor is the ability of the golf club shaft to resist a forced couple set up in the shaft as a result of the inertia of the ball imparting a resisting or opposing force to the point of impact on the golf club head. Since the centerline of the shaft is behind the point of impact, a clockwise force couple is built up in the shaft due to this eccentric loading. This causes the golf club head to rotate clockwise (looking down at the golf club head by a right-handed golfer) at the moment of impact. This action is more commonly known as "torque".

During the rest of the stroke the ball compresses until the stored energy is sufficient to overcome its inertia. The ball then begins to accelerate faster than that of the golf club head and moves away from the head. If the stored energy from the twisting couple at the moment of impact is not put back into the ball before the ball leaves contact with the golf club head then this energy will be lost. The spring rate and energy storing ability of the golf club shafts are therefore shown to be important factors in the amount of kinetic energy imported to the ball at, and subsequent to the point of impact. Also the ability of the shaft to maintain the club head in contact with the impacted ball for the longest period of time becomes the major function of the golf shaft.

Since all golfers are not the same size, do not possess the same amount of strength, it is necessary to manufacture shafts of varying lengths, weights, strengths, and flexes. These variations in shafts then enable all golfers to be fitted properly, whether they be children, men or women, young or old, weak or strong, tall or short, and amateur or professional.

Due to the wide variety and types of golf club shafts that must be manufactured to suit these innumerable demands, it is highly desirable that a single shaft could be manufactured that could be properly fit to the golf club head to provide a golf club that would suit the physical capabilities of a particular golfer.

A major object of the present invention is to supply a single shaft that is of such structure that it may be rotatably adjusted and secured to a golf club head for the shaft to have a desired stiffness against lateral flexing during the golfer's swing, will cause the golf club head to remain in contact with the impacted golf ball a maximum length of time to facilitate transfer of kinetic energy from the club head to the ball, and the shaft offering maximum resistance to rotation of the golf club head as the latter transfers kinetic energy to the struck golf ball.

SUMMARY OF THE INVENTION

The golf club shaft of the present invention includes first and second elongate tapered segments of semi-circular transverse cross-section that have the free longitudinal edges thereof in abutting contact with opposite sides of an elongate tapered web. Both the segments and the web are preferably formed from an ultra high tensile steel or like resilient material. The segments and web are permanently bonded to one another at their areas of contact by two longitudinally extending laser produced weld beads.

The first end portion of the shaft which has the smallest transverse cross section is inserted in the tubular upwardly extending neck of a golf club head and permanently bonded thereto after the web has been oriented relative to the striking surface of the club head to provide a shaft of desired stiffness. When the web is normal to the flat striking surface of a club head, the shaft will have maximum stiffness. The shaft will have minimum stiffness when the web is parallel to the striking surface of the golf club head. By angularly adjusting the web relative to the striking surface of the golf club head, shafts of intermediate stiffness between the maximum and minimum previously mentioned is provided.

The shaft is manufactured by permanently deforming elongate strips of ultra high tensile resilient steel to elongate tapered segments of semi-circular transverse cross-section between male and female dies. Elongate tapered webs are cut or otherwise formed from strips or sheets of high tensile steel. Two of the segments have the free longitudinal edges thereof placed in pressure abutting contact with opposite side edge portions of a tapered web, and when so disposed a laser beam longitudinally transverses the segments and web to form a longitudinally extending bead at the junction of the segments and web. The finished shaft has two longitudinally extending laser produced beads thereon in which the steel is of homogeneous consistency, and beads that require no heat treating to normalize the same. Excess material in the beads is severed from the exterior surface of the finished shaft, to provide the latter with a smooth external surface. If desired, the web may be pretensioned during the welding operation, with the tensioning released after the operation is completed. The tensioned web will cause the segments welded thereto to be in longitudinal compression.

The shaft after completion has the first end portion thereof inserted in the tubular neck of a golf club head, and rotatably adjusted therein to dispose the web at a desired relationship relative to the striking surface of the club head to provide a shaft of desired stiffness. The second end portion of the shaft after it has been permanently bonded to the golf club head may have a grip mounted thereon in a conventional manner. To lessen the weight of a golf club shaft, the web previously described may have a number of spaced openings formed therein.

BRIEF DESCRIPTION OF THE DRAWINGS

FIG. 1 is a perspective view of a male and female die that may pressure contact an elongate strip of resilient ultra high tensile strength steel or like material to form the same into an elongate tapered section of semi-circular cross section used in forming the golf club shaft;

FIG. 2 is a perspective view of the elongate tapered section formed by the use of the apparatus illustrated in FIG. 1;

FIG. 3 is an elongate tapered web that is intermediately disposed between two of the elongate sections of semi-circular transverse cross section to define the tapered golf club shaft;

FIG. 4 is a diagrammatic view of two of the tapered sections that have the free end edges thereof in contact with opposite sides of a web, and the web and sections at their areas of contact being welded by a laser beam to define a longitudinally extending bead;

FIG. 5 is a transverse cross-sectional view of the shaft after the same has had two oppositely disposed longitudinally extending beads formed thereon to join the two sections and web together as an integral unit;

FIG. 6 is a top plan view of a golf club head in contact with a golf ball shown in phantom line, and a portion of a golf club shaft extending upwardly therefrom, with the web in the shaft normal to the striking face of a golf club head to provide a shaft of maximum rigidity;

FIGS. 6*a*, 6*b* and 6*c* are perspective views of portions of the golf club shaft rotatably adjusted relative to the golf club head to impart stiffness of various magnitudes to the golf club shaft portion shown;

FIG. 7 is a perspective view of a portion of a golf club shaft that includes longitudinally extending webs, with the web being lightened by a number of spaced openings formed therein; and FIG. 8 is a top plan view of a chart utilized in orienting the golf club shaft relative to the striking face of a golf club head to impart a desired stiffness to the shaft so oriented and permanently bonded to the golf club head.

DESCRIPTION OF THE PREFERRED EMBODIMENTS

In FIG. 1 an upper die block 10 is shown that has an elongate tapered rib 12 of semi-circular transverse cross-section projecting downwardly from a lower flat surface 14 thereof that is vertically aligned with a conforming elongate groove 16 that extends downwardly into a flat face 18 of a lower die block 20. When an elongate strip 22 of ultra high tensile steel is subjected to pressure by movement of die blocks 10 and 20 relative to one another by conventional power means (not shown), the strip is formed by rib 12 and groove 16 into an elongate section 24 as shown in FIG. 2, which has lips 24*a* extending outwardly from the longitudinal sides thereof that are removed by mechanical chemical or electrical means (not shown) of a conventional manner.

In FIG. 3 an elongate tapered web 26 is shown that is formed from a resilient sheet material such as ultra high tensile steel or the like.

In FIG. 4 two laterally movable members 28 and 30 are shown that have concave faces 28*a* and 30*a* that engage the exterior surfaces of two sections 24 and force the free longitudinal edges of the latter into contact with opposite side edges of a web 26. Laser welding means 32 move longitudinally relative to the web 26 and sections 24 and by a laser beam 34 effect a weld 36 at the junction of the sections and web. Two oppositely disposed beads 36 are formed as above-described to complete a shaft A as shown in transverse cross section in FIG. 5.

A golf club head B is shown in FIG. 6 that has a flat forwardly disposed striking surface 38 that preferably impacts a golf ball 40 shown in phantom line at a point of impact 42. A tubular neck 44 extends upwardly from one side of head B and has a first end portion 46 disposed therein. Shaft A has a centerline 48 that when projected to striking face 38 is separated by a distance 50 from a centerline that extends through point of impact 42.

The shaft A is shown in FIG. 6 as so oriented that web 26 is normal to striking face 38, with the shaft then being of maximum stiffness. When the club head B impacts ball 40 at point of impact 42, the club head due to the inertia of the ball tend to pivot clockwise relative to shaft A. The torque imposed on the shaft A is the magnitude of the force at point of impact 42 times the distance 50 shown in FIG. 6. This torque is distributed by the web 26 over the entire longitudinal area of shaft A, and the torque per unit of area being a minimum, and the head B likewise pivoting a minimum relative to the shaft. Thus, the centerline 52 deviates a minimum from the direction of movement of the head B as a golfer swings, and the ball 40 may be propelled to a desired destination with a high degree of accuracy.

In FIG. 6*a* the web 26 is illustrated as being parallel to striking face 38, and the shaft A will be of minimum stiffness.

FIGS. 6*b* and 6*c* illustrate the web 26 as being angularly disposed relative to striking face 38 to provide a shaft A of a stiffness intermediate the maximum and minimum previously mentioned.

An alternate form of shaft A' is shown in FIG. 7 in which the web 26' has a number of spaced transverse openings 60 formed therein to lighten the shaft. Shaft A' operates in the same manner and provides the same operational advantages as shaft A but is of lighter weight than the latter.

In using the invention a number of clubs C are manufactured each of which includes a head B and shaft A, but with each club having the web 26 oriented relative to the striking face 38 at a different angle. Each club C is preferably identified by a suitable insignia that indicates the orientation of web 26 of the shaft A thereof to the striking face 38 of head B. A potential purchaser tries out the clubs C, and selects the one thereof most suited to his physical characteristics.

The club C that the potential purchaser has selected is reproduced by the chart D illustrated in FIG. 8. Chart D includes a rigid sheet 62, preferably a transparent plastic, that has a centered straight line 64 defined thereon as can be seen in FIG. 8, with a protractor 66 being defined on the sheet to the left of line 64. A tapered slot 66 extends inwardly from edge 68 of sheet 62 and terminates at the center of the protractor.

The chart D is used by placing a club head B therebelow with the striking face 38 parallel to line 64. A shaft A is now disposed in a downward position in slot 66, with the lower end of the shaft in neck 44. The shaft A is now rotated in the neck to align the web 26 with the number on the protractor 66 that the potential purchaser has previously selected. The shaft A when so disposed is bonded to the neck 44 by conventional means. The sheet 62 may have explanatory statements 70 defined thereon adjacent protractor 66.

What is claimed is:

1. A method of forming a golf club shaft that may be adjusted to provide a desired stiffness thereto depending on the configuration it occupies relative to a golf club head to which it is secured, said method comprising the steps of:

a. transforming first and second strips of a resilient laser weldable metal into longitudinally tapering first and second sections of semi-circular transverse cross section, each of said sections having a pair of laterally spaced, longitudinally extending free edges;

b. providing an elongate tapered web of a resilient laser weldable metal;

c. disposing said pairs of free longitudinal edges of said first and second sections in pressure contact with opposite longitudinal side edge portions of said web;

d. laser welding said free edge portions of said first and second sections to opposite side edges of said web to provide first and second diametrically opposed, longitudinally extending beads in which portions of said sections and web of said laser weldable metal merge to secure said web to said sections without altering the physical characteristics of said sections; and e. trimming portions of said beads from said shaft that project outwardly from the exterior surface on the latter, with said shaft having maximum stiffness when said shaft is so secured to a golf club head that said web is normal to the striking face of said golf club head.

2. A method of forming a golf club shaft which includes the additional step of:

f. longitudinally tensioning said web during the time it is being laser welded to said first and second sections; and g. releasing said tension on said web after said laser welding is completed, with said web as it tends to contract after said laser welding maintaining said first and second sections in compression.

* * * * *